US005419368A

United States Patent [19]

Fiondella et al.

[11] Patent Number: 5,419,368

[45] Date of Patent: May 30, 1995

[54] VALVE WITH A REDUCED NUMBER OF EXHAUST PORTS AND VENTS

[75] Inventors: Stephen J. Fiondella, North Haven; Wilhelm H. Horlacher, Newington, both of Conn.

[73] Assignee: Honeywell Inc., Minneapolis, Minn.

[21] Appl. No.: 153,936

[22] Filed: Nov. 17, 1993

[51] Int. Cl.[6] ..... F15B 13/043

[52] U.S. Cl. ..... 137/625.64; 137/625.65

[58] Field of Search ..... 137/625.64, 625.65

[56] References Cited

U.S. PATENT DOCUMENTS

| | | | |
|---|---|---|---|
| 3,022,799 | 2/1962 | Padula | 137/625.65 |
| 3,191,626 | 6/1965 | Leibfritz | 137/635.64 X |
| 3,269,417 | 8/1966 | Lansky et al. | 137/625.64 |
| 3,444,895 | 5/1969 | Schnittker | 137/625.65 |
| 3,736,958 | 6/1973 | Rostad | 137/625.64 X |

FOREIGN PATENT DOCUMENTS

| | | | |
|---|---|---|---|
| 2826973 | 1/1980 | Germany | 137/625.65 |

*Primary Examiner*—Gerald A. Michalsky
*Attorney, Agent, or Firm*—William D. Lanyi

[57] ABSTRACT

A pilot valve is provided with internal conduits that eliminate the need for all but one exhaust or vent opening in the outer surface of the valve. The pilot vent is directed through a gap between inner and outer tubes so that the fluid flowing through the upper end of the pilot cavity can be directed to the single exhaust port of the valve. The piston cavity vent is similarly connected to the exhaust port through the use of a counterbore cavity formed between a portion of the cavity in which the driving end of the spool member is disposed and a conduit connecting the counterbore cavity to the exhaust port of the valve. In addition, a second exhaust port, if needed for the valve application, is provided completely internal to the surfaces of the valve body and connected via a conduit to the first exhaust port which extends through an outer surface of the valve body. Through the use of these various techniques, the present invention eliminates most vents and ports and reduces the necessary number of the openings in the outer surface of the valve body to a single exhaust port which can be appropriately connected to a means for exhausting the fluid into the environment based on the particular application in which the valve is used.

1 Claim, 9 Drawing Sheets

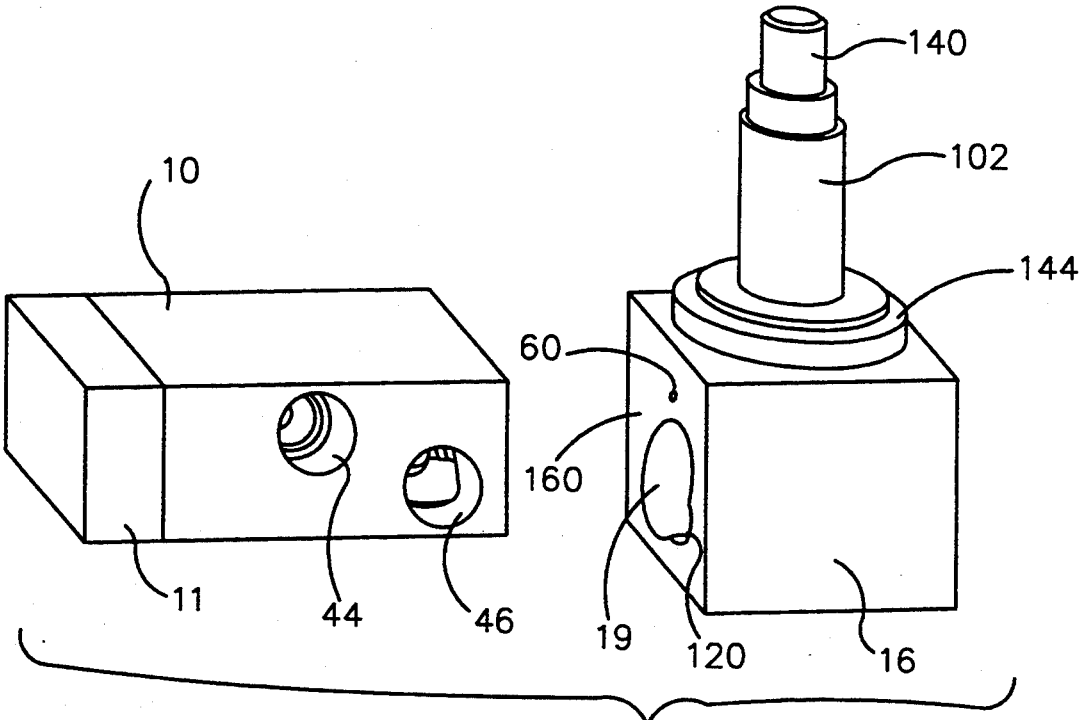
Fig. 3
Fig. 4
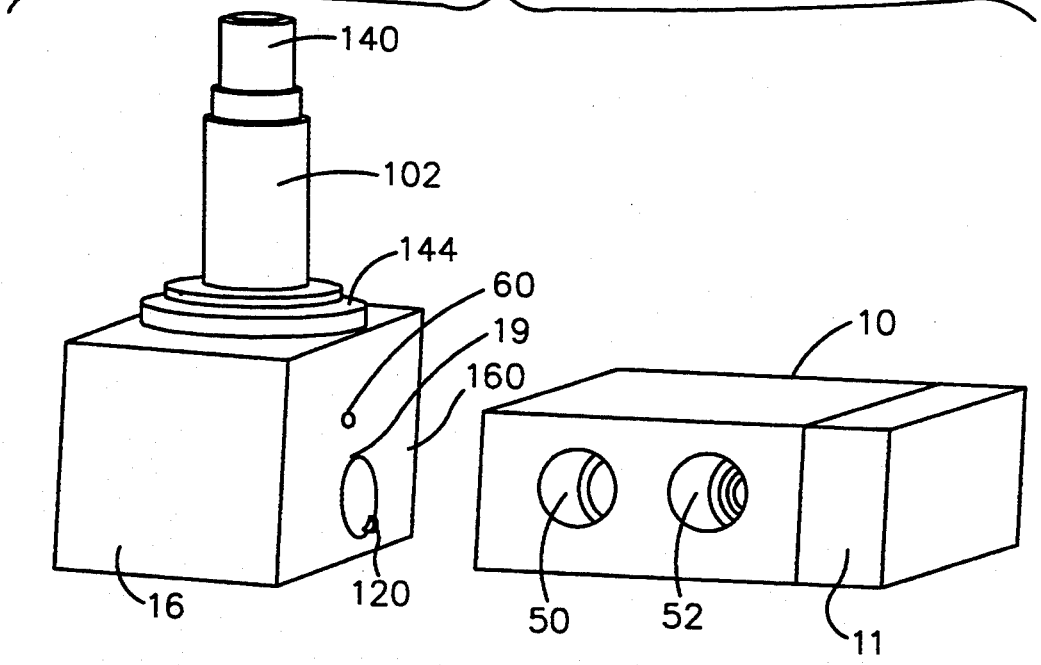

VALVE WITH A REDUCED NUMBER OF EXHAUST PORTS AND VENTS

BACKGROUND OF THE INVENTION

1. Field of the Invention

The present invention relates generally to a valve with a reduced number of exhaust ports and vents and, more particularly, to a pilot operated valve which eliminates the pilot vent, the piston cavity vent and one of two exhaust ports.

2. Description of the Prior Art

As will be described in greater detail in conjunction with FIG. 1, spool valves require vents and exhaust ports in order to operate properly when made in accordance with known techniques. If the spool valve is operated by a pilot valve, the pilot cylinder must also be provided with a vent.

In operation, the vents and exhaust ports create a significant problem in certain applications. For example, if the pilot operated spool valve is enclosed in a cabinet with electronic or electromechanical equipment, the venting of the valve within the cabinet structure can cause damage to the electrical equipment. Another problem that relates to the use of a pilot operated spool valve occurs when one or more of the vents becomes restricted. This restriction can occur because of the accumulation of dirt in the vent, the existence of an insect nest in the vent conduit or the obstruction of the vent conduit by frozen liquid. If a vent is plugged for any reason, the operation of the value is seriously impaired and a catastrophic failure can occur. The present invention minimizes the number of exhaust or vent openings of a pilot operated spool valve in several ways.

SUMMARY OF THE INVENTION

In a preferred embodiment of the present invention, a valve comprises a valve body which has a first cavity formed therein. The valve body has a first exhaust port connected in fluid communication between the first cavity and an outer surface of the valve body. A spool member is disposed within the first cavity which is shaped to receive the spool member in sliding association therein. The spool member is provided with a driving, or motor, end that is disposed with a chamber of the first cavity between a first portion of the chamber and a second portion of the chamber. The valve of the present invention also comprises a pilot valve body which has a second cavity formed within it. A plunger is disposed within the second cavity. The second cavity has a first end and a second end and is shaped to receive the plunger in sliding association between the first and second ends. The second end of the second cavity is connected in fluid communication with the first portion of the chamber. A first fluid connection is also provided by the present invention between the first end of the second cavity and the first exhaust port.

In a most preferred embodiment of the present invention, the first fluid connection comprises an inner tube and an outer tube arranged in concentric relation with each other with an opening formed therebetween. The opening can be a cylindrical gap between the two concentrically related tubes. One end of the opening is connected in fluid communication with the first end of the second cavity and the other end of the opening is connected in fluid communication with the first exhaust port.

The plunger of the pilot valve and the inner tube are shaped to provide a gap therebetween so that fluid communication is permitted between the first and second ends of the second cavity. This fluid communication allows fluid to flow past the plunger within the inner tube of the first fluid connection.

In one embodiment of the present invention, a second exhaust port is connected in fluid communication with the first cavity within the valve body. The first and second exhaust ports are connected in fluid communication with each other. The second exhaust port is completely contained within the valve body and not connected in fluid communication through the outer surface of the valve body except through the first exhaust port.

In a particular embodiment of the present invention, a second fluid connection is provided between the second portion of the first chamber and the first exhaust port. Although many types of pilot valves are known to those skilled in the art, a preferred embodiment of the present invention comprises a solenoid coil disposed around the plunger of the pilot valve.

BRIEF DESCRIPTION OF THE DRAWINGS

The present invention will be more fully understood from a reading of the Description of the Preferred Embodiment in conjunction with the drawings, in which:

FIG. 3 is a perspective view of the present invention;

FIG. 4 is an alternative perspective view of the present invention;

DESCRIPTION OF THE PREFERRED EMBODIMENT

Figure 1:
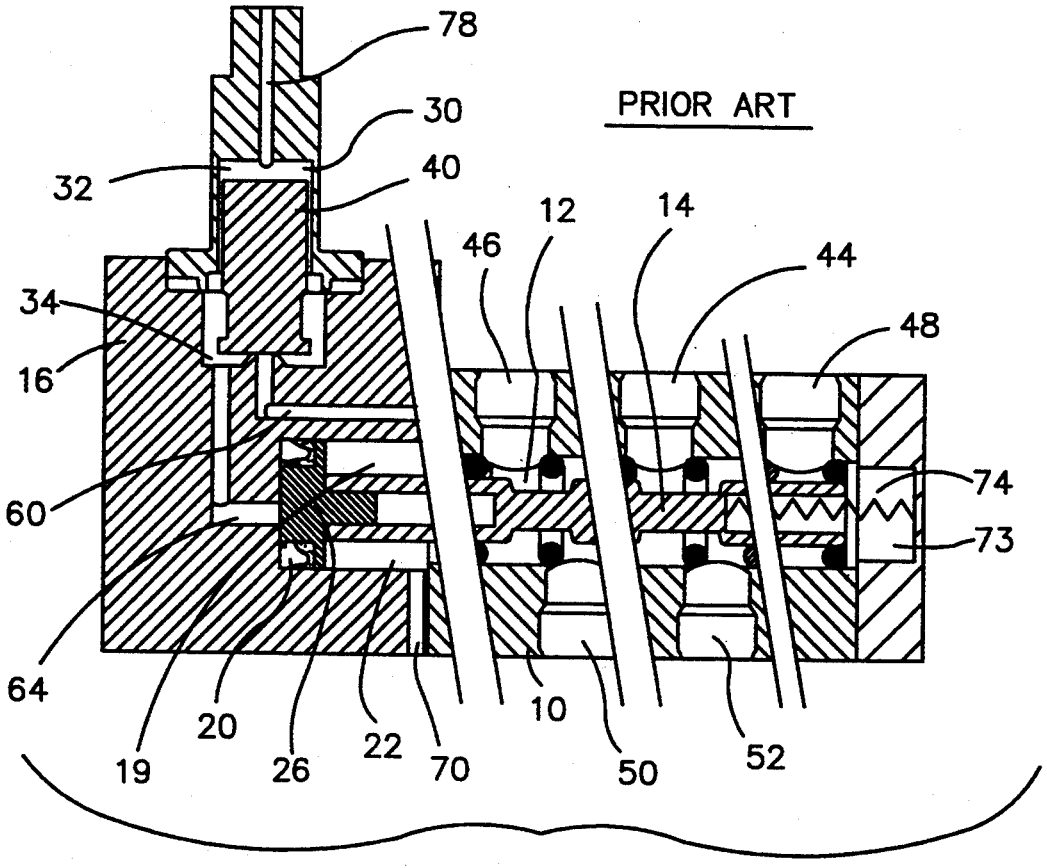
FIG. 1 illustrates a cross sectional view of a pilot valve made in accordance with known techniques.

Throughout the Description of the Preferred Embodiment, like components will be identified by like reference numerals. FIG. 1 shows a valve which is well known to those skilled in the art. The valve in FIG. 1 is illustrated in three broken segments to facilitate the description of the prior art. The valve comprises a valve body 10 which has a first cavity 12 formed therein. The first cavity 12 is shaped to receive a spool member 14 in sliding relation therein. In FIG. 1, the spool member 14 is shaped to move toward the left and right in the figure to connect various ports in fluid communication with each other.

The valve in FIG. 1 also comprises a pilot valve body 16. The first cavity 12 extends into both the valve body 10 and the pilot valve body 16 in FIG. 1, but it should be understood that this particular structure is not a requirement of all pilot valve structures. A chamber 19 is formed at the end of the first cavity 12. The chamber 19 comprises a first portion 20 and a second portion 22. The spool member 14 is provided with a driving end 26 which is disposed within the chamber 19 between the first portion 20 and the second portion 22.

The pilot valve body comprises a second cavity 30 formed therein and provided with a first end 32 and a second end 34. Within the second cavity 30, a plunger 40 is disposed and arranged in sliding association with the second cavity 30.

The exemplary valve shown in FIG. 1 is illustrated as having a pressure port 44, two exhaust ports, 46 and 48, a cylinder port 50 and a cylinder port 52 which can be connected in fluid communication with opposite sides of a pneumatic cylinder. Depending on the position of the spool member 14 within the first cavity 12, the pressure port 44 is connected in fluid communication with either cylinder port, 50 or 52, and the other cylinder port is connected in fluid communication with one of the exhaust ports, 46 or 48. Movement of the spool member 14 can therefore be used to provide alternating pressure to either cylinder port, 50 or 52, in order to cause reciprocating movement of a cylinder attached to the valve shown in FIG. 1.

It should be understood that the conduit 60 shown within the pilot valve body 16 connects the pressure inlet 44 in fluid communication with the second end 34 of the second cavity 30. When the plunger 40 is in the position shown in FIG. 1, conduit 60 is blocked and fluid communication between conduit 60 and conduit 64 is prevented. When plunger 40 is caused to move upward, such as the operation of a solenoid coil, conduits 60 and 64 are connected in fluid communication with each other through the second end 34 of the second cavity 30 and fluid is permitted to flow under pressure into the first portion 20 of the chamber in which the driving end 26 of the spool member 14 is disposed. A piston cavity vent 70 is provided to permit fluid to flow out of the second portion 22 of the chamber. The increase in pressure of the first portion 20 over the pressure in the second portion 22 causes the driving end 26 of the spool member 14 to move toward the right against the resistence provided by the spring 74.

When the plunger 40 is in its upward position, the upper portion of the plunger 40 blocks a pilot vent 78 and prevents fluid from flowing out of the first end 32 of the second cavity 30. As is well known to those skilled in the art, when the spool member 14 is in its extreme left position as shown in FIG. 1, the pressure inlet 44 is connected in fluid communication with the cylinder port 52, while the other cylinder port 50 is connected with its associated exhaust port 46. When the spool member 14 is moved into its opposite position, toward the right of FIG. 1, the pressure port 44 is connected in fluid communication with the other cylinder port 50 and cylinder port 52 is connected in fluid communication with the other exhaust port 48. Chamber 73 can be vented to release pressure when spool member 14 moves to the right in FIG. 1 or vice versa.

When the plunger 40 is moved downward, as illustrated in FIG. 1, conduit 60 is blocked and conduit 64 is deprived of pressure from the pressure inlet port 44. Conduit 64 is connected, through the second end 34 of the second cavity 30, to the space surrounding the plunger 40 and, in turn, to the first end 32 of the second cavity 30. The space surrounding the plunger 40 can also be enhanced by the provision of axial flutes (not shown) to facilitate the passage of fluid upward through the second cavity 30 from the second end 34 to the first end 32 around and through the plunger 40. This flow connects the conduit 64 in fluid communication with the pilot vent 78 and permits the fluid to be evacuated from the first portion 20 of the chamber to the atmosphere.

With continued reference to the prior art valve shown in FIG. 1, it can be seen that this type of pilot operated valve requires at least four exhaust ports, or vents, to the environment surrounding the valve. The exhaust ports, 46 and 48, permit the flow of fluid from various portions of the first cavity 12 to the environment surrounding the valve. In addition, the piston cavity vent 70 permits the flow of fluid from the second portion 22 of the chamber 19 into the environment surrounding the valve or, alternatively, from the environment surrounding the valve into chamber 19. Finally, the pilot vent 78 permits the flow of fluid from within the second cavity 30 to the environment surrounding the valve.

As described above, the provision of a plurality of vents and exhaust ports creates severe problems when the valve is used in association with a cabinet of electrical equipment. Furthermore, the potential blockage of any one of the vents can create a severe problem that can possibly result in a catastrophic failure of the valve and its related equipment. The primary purpose of the present invention is to eliminate several of the fluid connections between the internal portions of the valve and the environment and thereby minimize the problems associated with the plurality of fluid connections between the internal portions of the valve and the environment surrounding the valve body.

Figure 2:
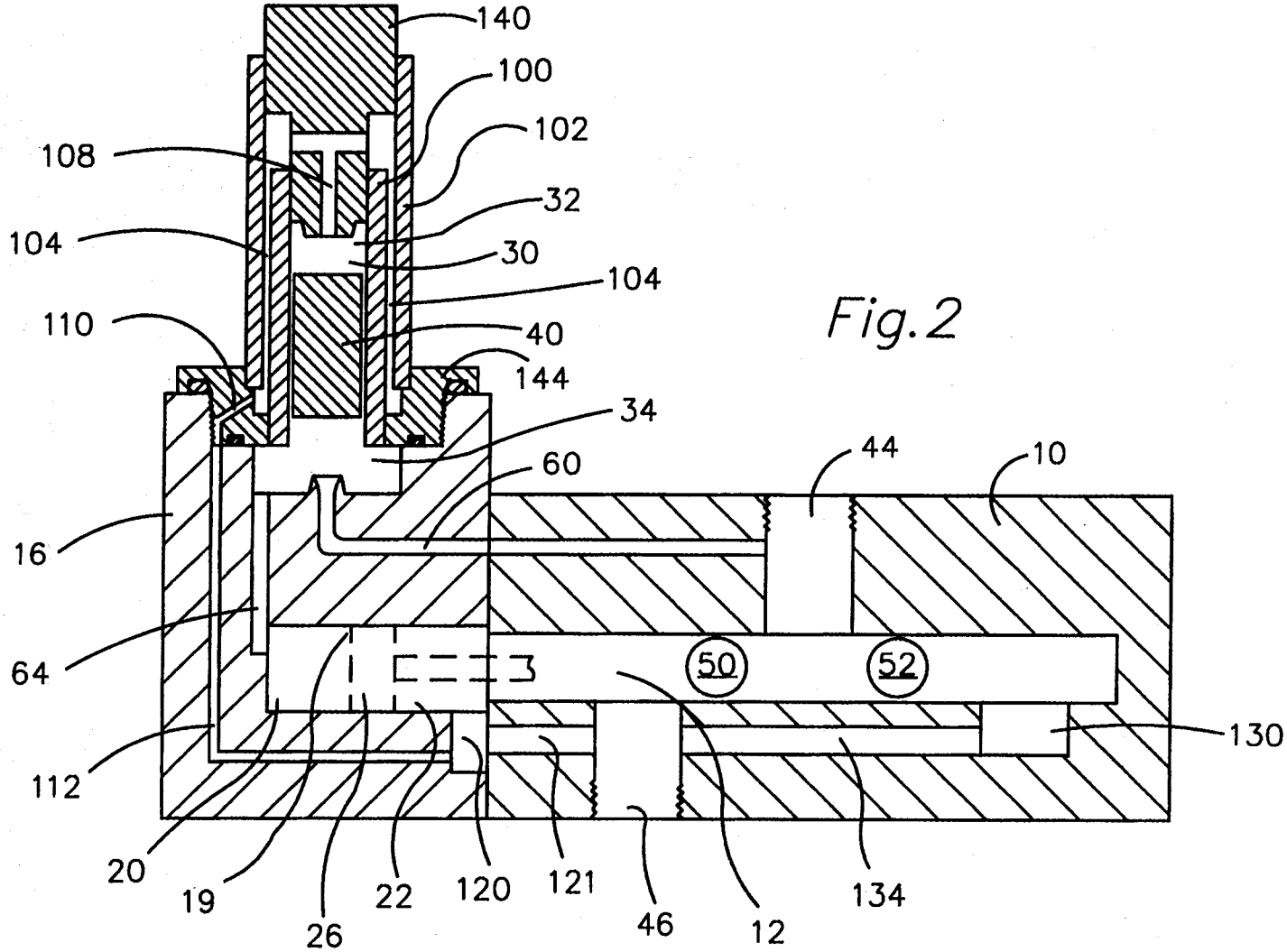
FIG. 2 is a schematic representation of a cross section of a valve made in accordance with the present invention.

FIG. 2 is a schematic representation of the concepts of the present invention. The cross sectional view of FIG. 2 is significantly simplified in order to facilitate the explanation of those principles involved in a preferred embodiment of the present invention. A particular embodiment will be described below following an explanation of these basic principles. For purposes of this explanation, the portions of the valve shown in FIG. 2 which are functionally similar to portions of the valve shown in FIG. 1 will be identified with the same reference numerals.

With reference to the valve body 10 shown in FIG. 2, the first cavity 12 is formed in a generally similar manner to that described above in conjunction with FIG. 1. The two cylinder ports, 50 and 52, are shown extending horizontally into the first cavity 12 rather than vertically as in FIG. 1. This change has been incorporated for the purpose of simplifying the illustration in FIG. 2. A pressure inlet port 44 is connected in fluid communication with the first cavity 12 as is a first exhaust port 46 which is shown extending downward from the first cavity 12 rather than upward as in FIG. 1. This change in the illustration has also been provided for the purpose of simplifying the illustration in FIG. 2.

The plunger 40 is disposed within a second cavity 30 which has a first end 32 and a second end 34. This arrangement is generally similar to that described above in conjunction with FIG. 1.

As can be seen, the pilot vent 78 of the prior art is eliminated in the embodiment of the present invention shown in FIG. 2. In order to accomplish this, the pilot valve body comprises an inner tube 100 and an outer tube 102 which are arranged in concentric relation with each other. An opening 104 exists between the inner and outer tubes. Instead of providing a pilot vent 78, a conduit 108 is used to connect the first end 32 of the second cavity 30 in fluid communication with the opening 104 between the inner tube 100 and the outer tube 102. Conduit 110 connects the gap, or opening 104, in fluid communication with conduit 112 which, in turn, connects it in fluid communication with the exhaust port 46. The use of conduit 108, conduit 110 and the opening 104 between the inner tube 100 and the outer tube 102 provides fluid communication between the second cavity 30 and the exhaust port 46 and permits the present invention to eliminate the need for a pilot vent 78 as shown in the prior art valve of FIG. 1.

Another feature of the present invention is illustrated in FIG. 2. A counterbore 120 is provided between the second portion 22 of the chamber and the exhaust port 46. This connection permits the piston cavity vent 70, which is shown in FIG. 1, to be eliminated. Instead of venting the second portion 22 of the chamber to the atmosphere, as in the prior art valve of FIG. 1, the present invention shown in FIG. 2 connects the second portion 22 of the chamber in fluid communication with the first exhaust port 46 and allows the second portion 22 to be vented to a common outlet with the first exhaust port 46.

FIG. 2 also illustrates another feature of the present invention which eliminates the second exhaust port 48 which is shown in FIG. 1. Instead of connecting the other exhaust port 130 between the first cavity 12 and an external surface of the valve body 10, the second exhaust port 130 is connected to the first exhaust port 46 by a conduit 134. The second exhaust port 130 and conduit 134 are both completely contained within the structure of the valve body 10 and therefore it does not require an additional exhaust port which extends through the outer surface of the valve.

By comparing FIGS. 1 and 2, it can be seen that the total number of exhaust openings of the valve has been reduced from four to one by the concepts of the present invention. In FIG. 1, the prior art valve is illustrated as having two exhaust ports, 46 and 48, a piston cavity vent 70 and a pilot vent 78. All of these exhausts require the emission of fluids from the valve body to the environment surrounding the valve. In contradistinction to the valve shown in FIG. 1, the valve of the present invention illustrated in FIG. 2 only requires a single exhaust port which is illustrated and identified as the first exhaust port 46.

With continued reference to FIGS. 1 and 2, it should be understood that the pressure inlet port 44, the exhaust ports, 46 and 48, and the two cylinder ports, 50 and 52, of the prior art valve are all illustrated in FIG. 1 as being disposed in a common plane. However, the view in FIG. 2 is intended to demonstrate that this is not a requirement of valves made in accordance with known techniques. Instead, the location of the various ports, identified by reference numerals 44, 46, 48, 50 and 52, can be disposed at different positions extending through the valve body in fluid communication with the first cavity 12. It should also be understood that the schematic illustration of the present invention in FIG. 2 illustrates the various ports, 44, 46, 50 and 52 in particular positions which facilitate the illustration and description of the embodiment. The locations illustrated in FIG. 1 are also not limiting to the present invention.

In order to accomplish the structure shown in FIG. 2 in relation to the pilot valve body, the inner tube 100 and outer tube 102 are attached to a structure 140 through which conduit 108 is formed as shown. Furthermore, the opposite ends of the inner and outer tubes are attached to a threaded structure 144 which is shaped to be received in threaded association with the other portion of the pilot valve body 16. The threaded member 144 is provided with conduit 110 extending through it to permit the fluid communication with conduit 112 as described above. The inner tube 100 is shaped to permit the plunger 40 to move up and down within it and, in addition, to permit fluid to flow between the plunger 40 and the inner cylindrical surface of the inner tube 100. This passage of fluid between the first end 32 and the second end 34 of the second cavity 30 can be further facilitated by providing axial flutes (not shown in FIG. 2) extending along the outer surface of the plunger 40.

FIG. 3 shows a perspective view of the valve body 10 separated slightly from the pilot valve body 16 for the purposes of illustrating the conduits formed in both the valve body and the pilot valve body. The illustration of FIG. 3 shows the various openings and conduits in the actual positions where they are located in a particular preferred embodiment of the present invention. It should be understood that the illustration in FIG. 2 shows the same openings and conduits, but in slightly different positions for the purpose of facilitating the illustration and the description above.

In FIG. 3, the cover 11 is shown attached to a valve body 10. The cover 11 is used to facilitate the forming of the internal openings of the valve body 10. In other words, certain conduits are more easily formed from one end of the valve body and the use of the cover 11 permits those conduits to be formed entirely through the length of the valve body with the cover being used to seal one end of the valve body. Extending through one surface of the valve body 10 is the pressure inlet port 44 and the first exhaust port 46. In operation, the pressure inlet port 44 would be connected to a source of pressurized fluid. This pressurized fluid would then be used for the purpose of operating the internal spool 14 of the valve and also providing fluid power to an associated component, such as a cylinder actuator, that is connected to the cylinder ports 50 and 52.

With continued reference to FIG. 3, the chamber 19 is shown formed in a surface of the pilot valve body 16. In addition, a counterbore 120 is formed in the surface of the pilot valve body and in fluid communication with the chamber 19. As described above in conjunction with FIG. 2, the counterbore 120 allows the second portion 22 of the chamber 19 to be connected in fluid communication with the first exhaust port 46. As also described above, conduits 110 and 112 provide the inter connection between the counterbore 120 and the gap 104. Directly above the chamber 19 in FIG. 3 is shown conduit 60. With reference to FIGS. 2 and 3, it can be seen that conduit 60 provides a portion of the entire conduit required to connect the pressure inlet 44 with the second end 34 of the second opening 30 within the pilot valve body. In the upper portion of the pilot valve body 16, the threaded member 144 is shown attaching the cylindrical portion of the pilot valve structure to the block which forms the major portion of the pilot valve body. The outer tube 102 is shown extending from the threaded member 144 and the structure 140 is shown extending upward from the outer tube 102.

FIG. 4 is a perspective view of the components in FIG. 3, but from an opposite side so that the two cylinder ports, 50 and 52, of the valve body can be shown. As illustrated in FIG. 4, the cylinder ports, 50 and 52, extend through a surface of the valve body 10 in a direction opposite to the direction in which the pressure inlet port 44 and exhaust port 46 extend from it. The elements shown in association with the pilot valve body 16 in FIG. 4 are the same as those described above in conjunction with FIG. 3.

Figure 5:
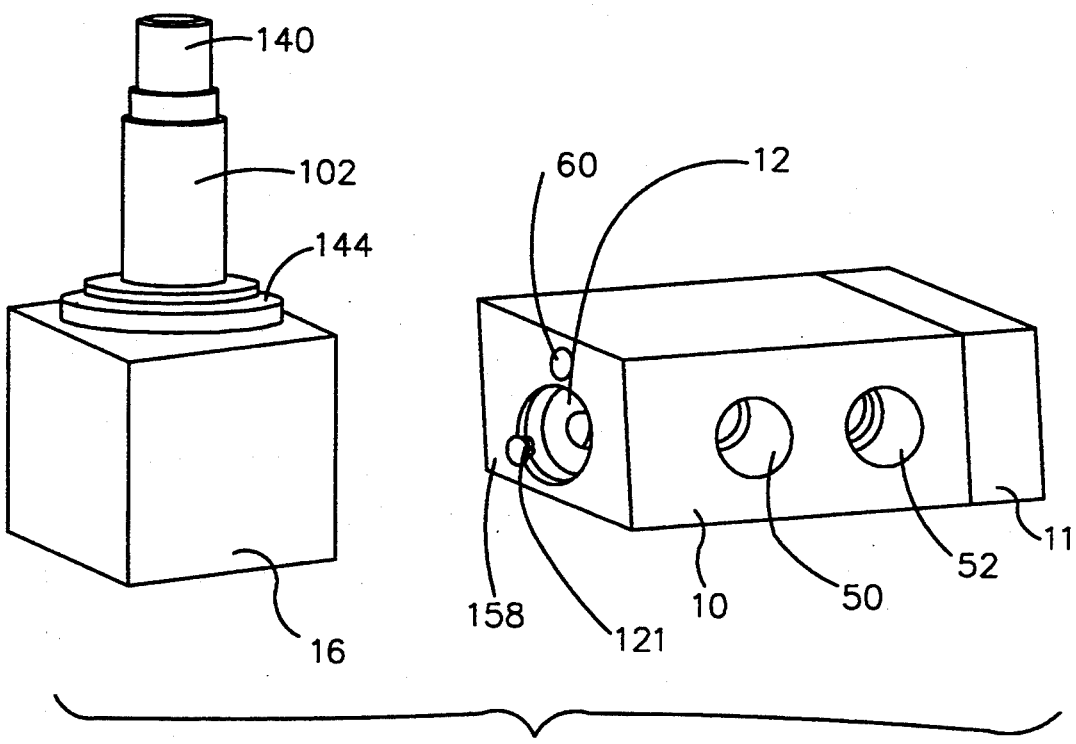
FIG. 5 is a perspective view of the present invention from a direction opposite to that of FIG. 3.

FIG. 5 illustrates a perspective view similar to that shown in FIG. 4, but rotated slightly to permit an additional surface 158 of the valve body 10 to be seen. The surface of the valve body 10 which is intended to be attached to the pilot valve body 16 is illustrated in FIG. 5 with the continuation portion of conduit 60. From the point where conduit 60 extends from the surface 158 of the valve body 10, it extends axially through the valve body and intersects the pressure inlet port 44. This relationship is illustrated schematically in FIG. 2. A conduit 121 is also shown formed in the surface 158 of the valve body 10 in FIG. 5. This conduit 121 is in fluid communication with the counterbore 120 in pilot valve body 16.

Figure 6:
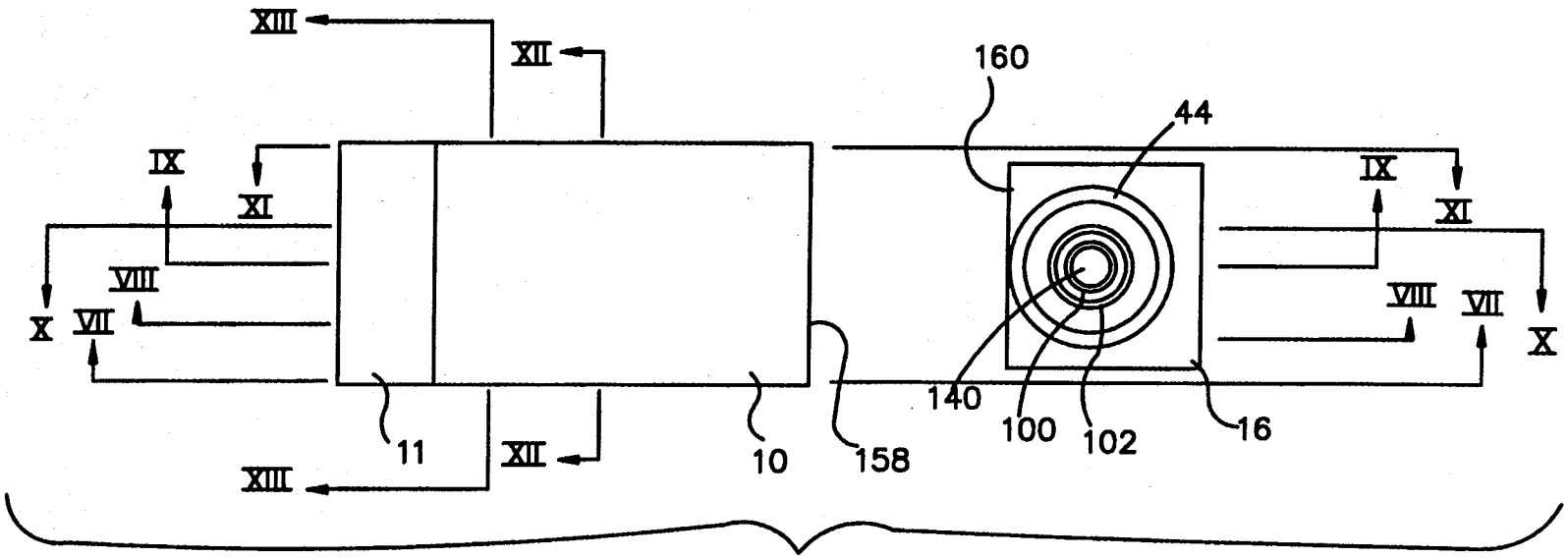
FIG. 6 is a top view of the present invention.

FIG. 6 is a top view of the valve body 10 and pilot valve body 16. It is provided for the purpose of illustrating the locations of various section views in the subsequent figures.

Figure 7:
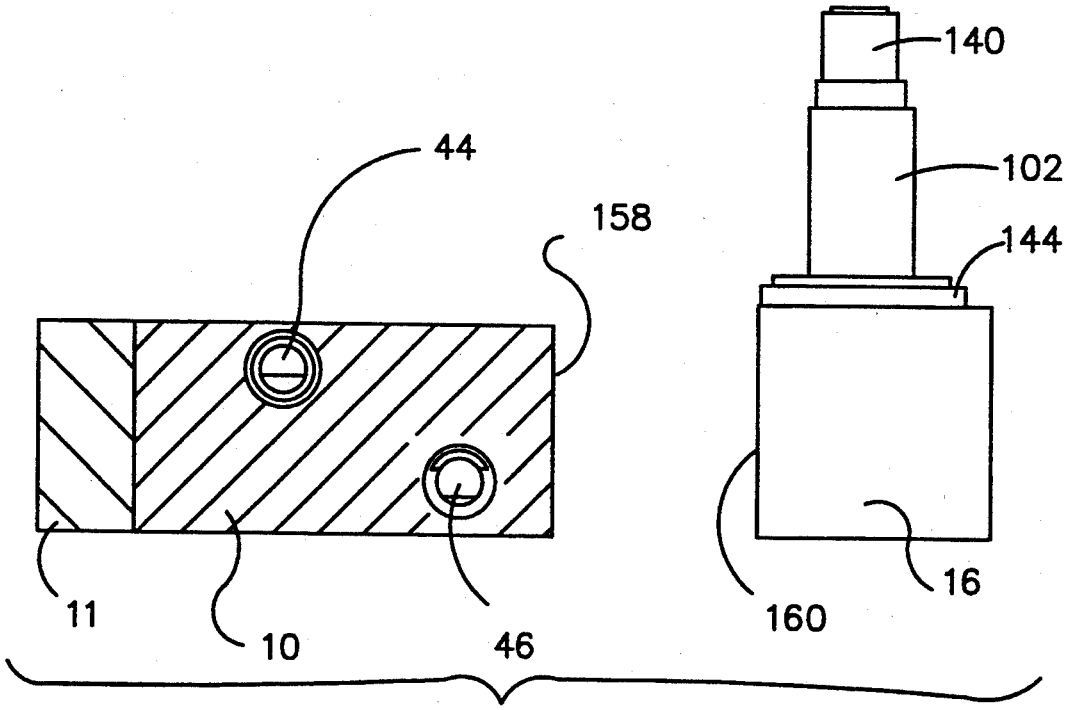

FIG. 7 illustrates a sectional view which intersects the valve body 10 slightly within the surface of the valve body in which the pressure inlet port 44 and exhaust port 46 intersect the surface.

Figure 8:
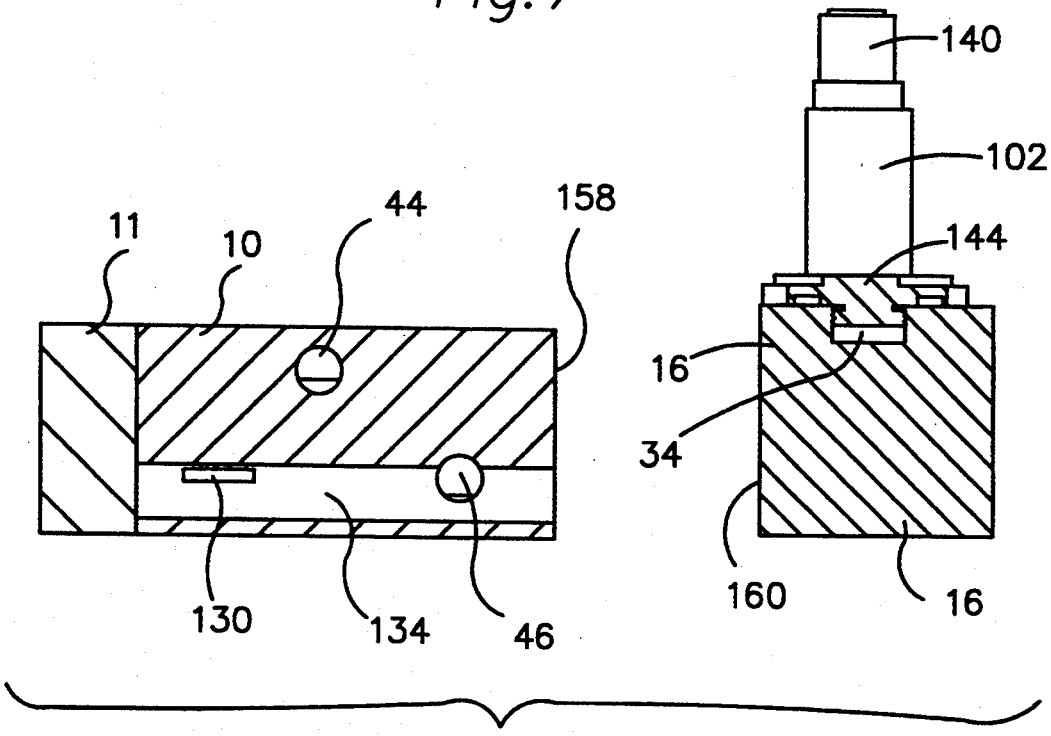

FIG. 8 shows a sectional view that illustrates the conduit 134 which connects the first exhaust port 46 with a second exhaust port 130. The generally rectangular illustration 130 in FIG. 8 is the result of the intersection surface between the generally cylindrical exhaust port 130 and the generally cylindrical conduit 134 extending perpendicularly to each other. The section view in FIG. 8 also shows the second end 34 of the second cavity within the pilot valve body 16.

Figure 9:
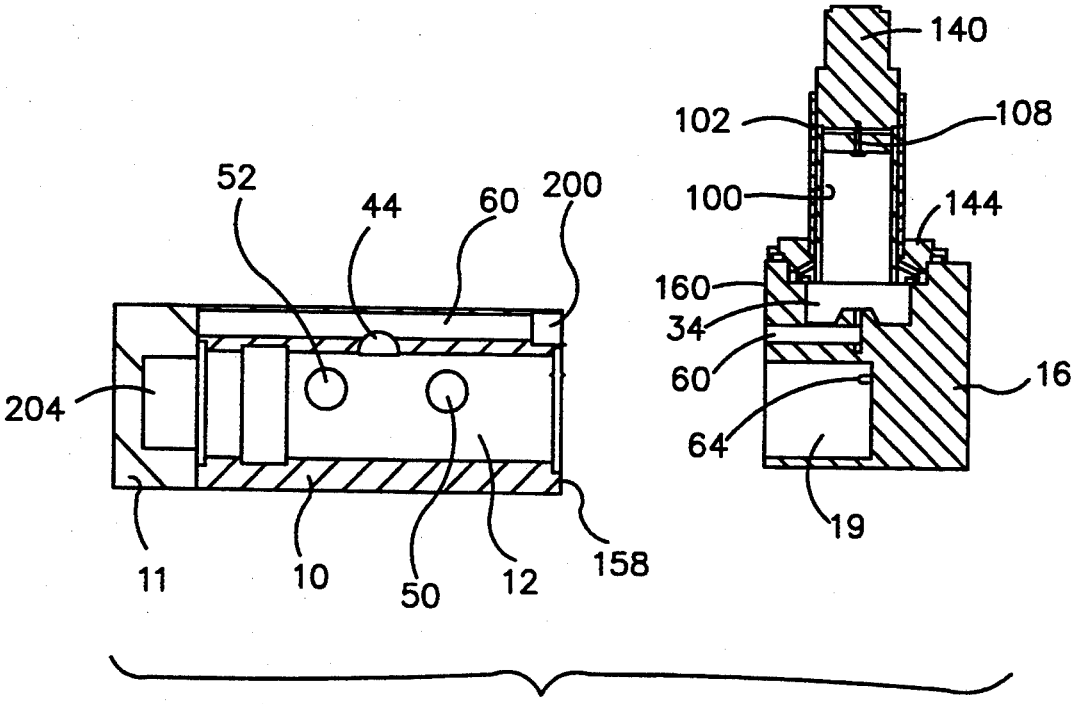

FIG. 9 is a sectional view taken through the central portion of the valve body and pilot valve body in FIG. 6. The first cavity 12 is shown with the pressure inlet 44 and cylinder ports 50 and 52 intersecting it. In addition, conduit 60 is illustrated extending through the valve body 10 and partially through the pilot valve body 16. The enlarged portion 200 of the conduit 60 in the valve body 10 is provided in one particular embodiment of the present invention to contain a filter and a seal which are not illustrated in the figures. The opening 204 formed in the cover 11 provides a seat for the spring 74 shown in FIG. 1.

Figure 10:
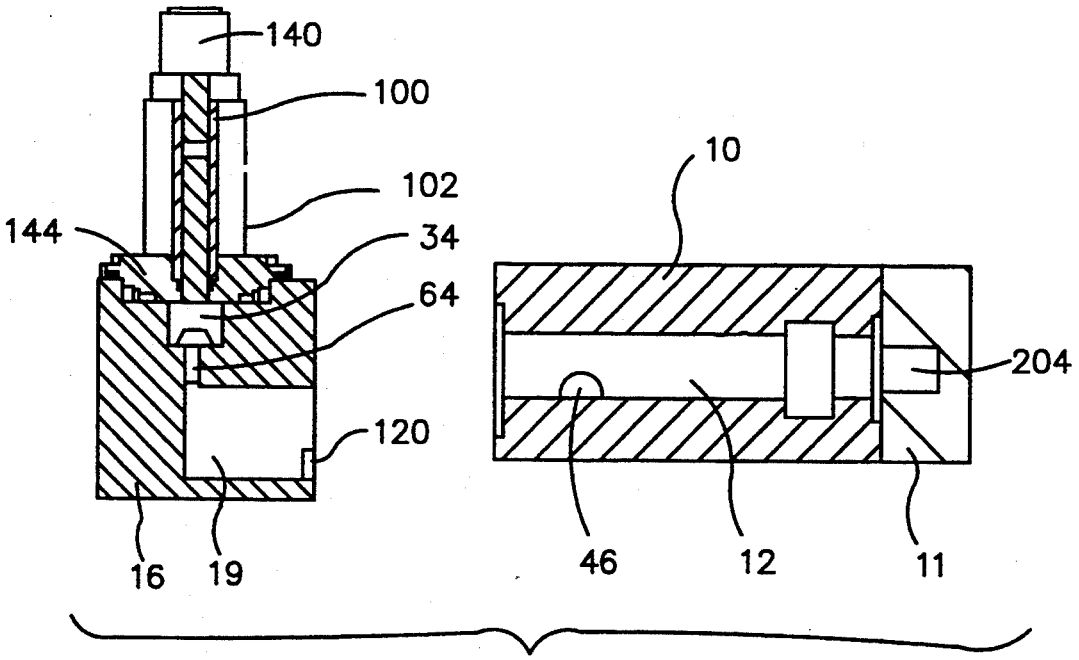

With continued reference to FIG. 9, conduit 64 is shown intersecting chamber 19 to provide fluid communication between the first portion 20 of cavity 19 and the second end 34 of the second cavity 30. FIG. 10 illustrates a sectional view that shows the conduits and openings described above. In the valve body 10, the first exhaust port 46 is shown intersecting the first cavity 12. In addition, conduit 64 is shown extending between the chamber 19 and the second end 34 of the second cavity 30.

Figure 13:
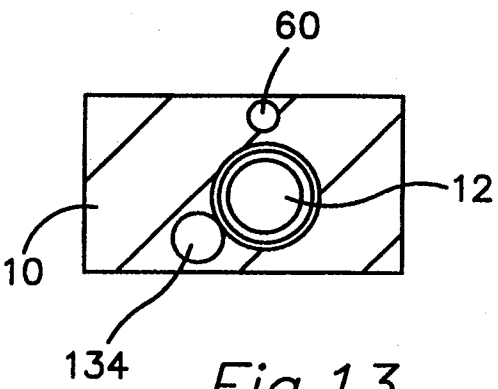
FIGS. 7, 8, 9, 10, 11, 12, 13 and 14 are section views taken with respect to the top view of FIG. 6.
Figure 12:
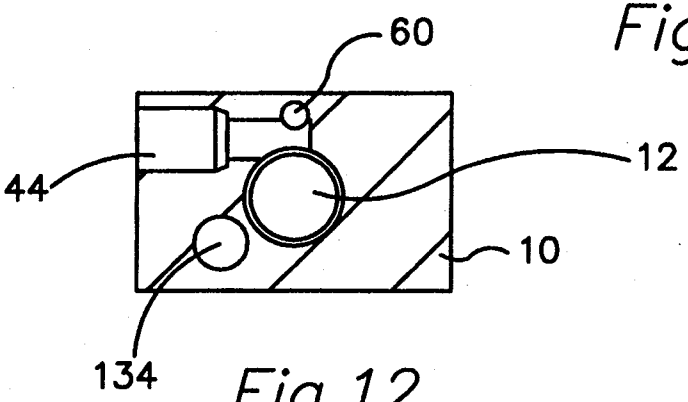
Figure 11:
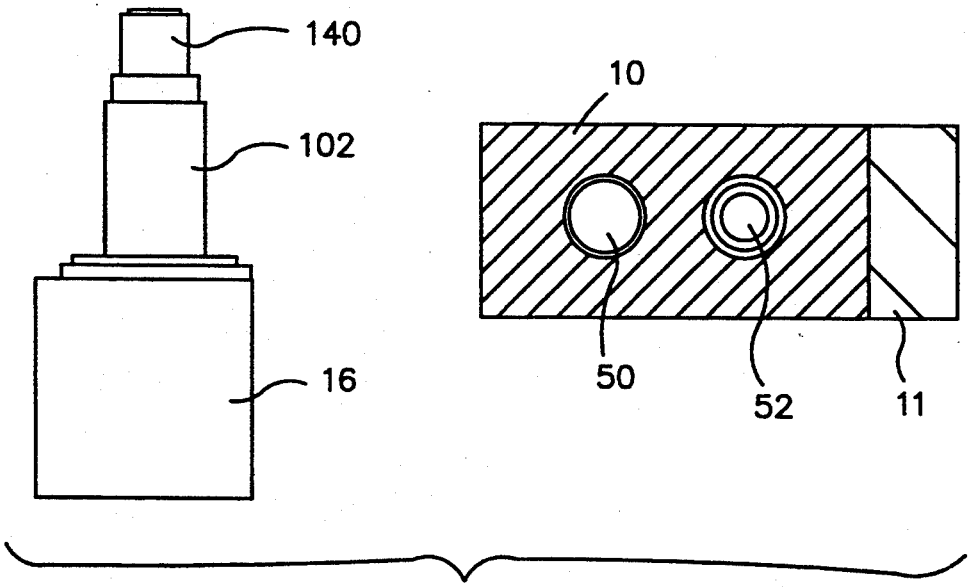

FIG. 11 is a sectional view of the valve in FIG. 6, showing the cylinder ports, 50 and 52, extending toward a surface of the valve body 10. In the sectional view of FIG. 12, the conduit 134 is illustrated in its position relative to the first cavity 12. It extends axially through the valve body 10 in order to provide a fluid connection between the first exhaust port 46 and the enclosed exhaust port 130. The pressure inlet port 44 is shown extending into the valve body 10 and intersecting the first cavity 12 and conduit 60. With reference to FIGS. 2 and 12, it can be seen that conduit 60 provide fluid communication between the pressure inlet port 44 and the second end 34 of the second cavity 30 and that the pressure inlet port 44 also is connected in fluid communication with the first cavity 12. FIG. 13 is a sectional view that shows the relative positions of the first cavity 12, conduit 60 and conduit 134.

Figure 14:
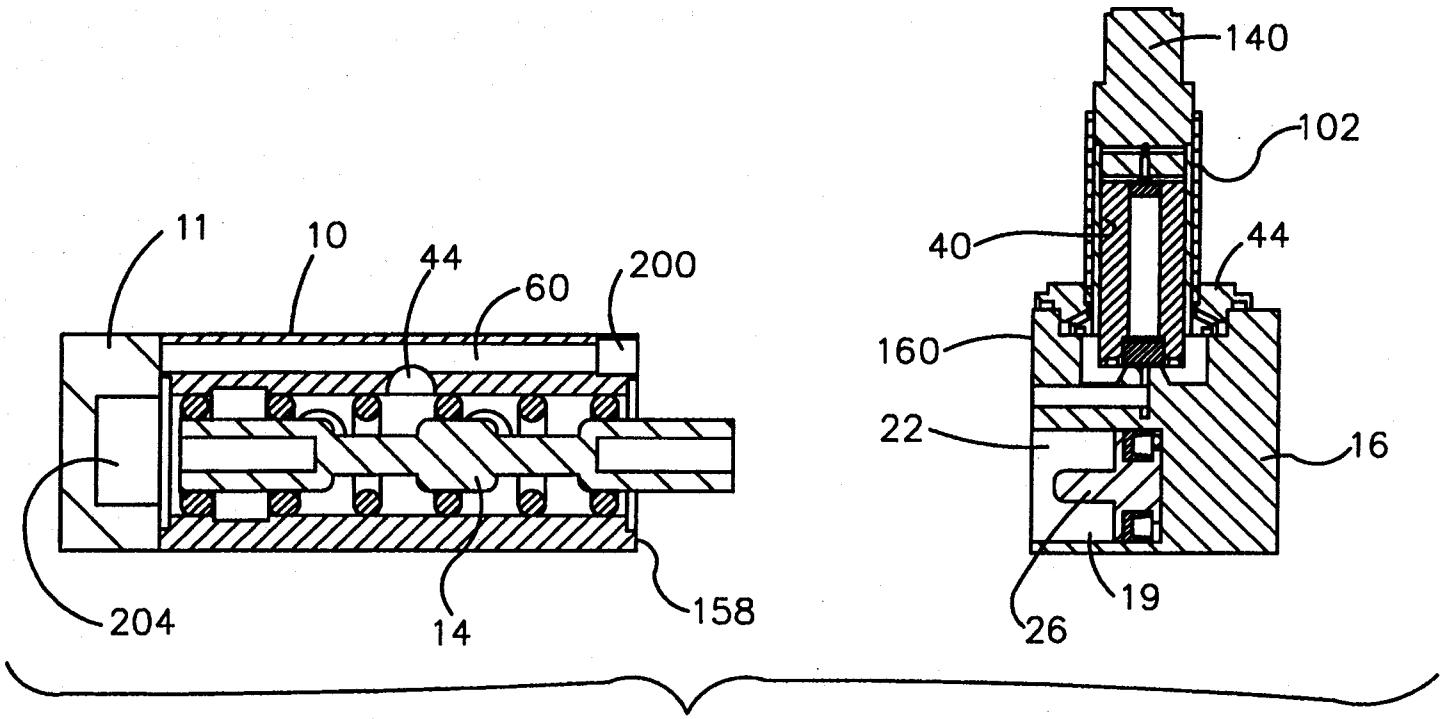

FIG. 14 is a section view of FIG. 6 taken at the same location as the section view of FIG. 9. However, in FIG. 14, the spool member 14 and the plunger 40 are shown within the first cavity 12 and second cavity 30, respectively. The spool member and plunger are similar to those known to those skilled in the art and do not directly relate to the novel aspects and characteristics of the present invention. FIG. 14 is provided to show the physical relationship of the spool member 12 and plunger 40 to the various cavities and conduits described above and illustrated in the plurality of sectional views of FIG. 6.

With reference to the schematic illustration of FIG. 2 and to the various sectional views described above, it can be seen that the present invention provides several significant advantages in comparison to valves known to those skilled in the art. Most particularly, the present invention eliminates most of the exhaust and vent openings that normally exist in the outer surfaces of valve bodies and pilot valve bodies. For example, the piston cavity vent 70 and the pilot vent 78 are completely eliminated from the valve made in accordance with the present invention and illustrated in FIG. 2. In addition, one of the two exhausts, 46 and 48, shown in the prior art valve of FIG. 1 has been eliminated and replaced by an exhaust port 130 that is completely contained within the valve body 10. As described above, the elimination of these ports and vents is significant because of the deleterious results that can occur when a valve of this type is used in certain applications. When the valve is disposed within a cabinet that also contains electronic or electrical equipment, the multiple exhausts and vents of a valve body must be taken care of to prevent the exhaust from causing damage to other components. In addition, a plurality of exhausts and vents increases the probability that one or more of the openings will become obstructed by debris, insects, insect nests, frozen liquid or other forms of obstruction. As illustrated in the figures, the only exhaust or vent port of the present invention is the first exhaust port 46. In applications of the type described above, the single exhaust port 46 can be appropriately connected to an acceptable means for directing the exhaust away from sensitive equipment. The present invention achieves the elimination of the vents and exhaust ports in three ways. First, the pilot vent 78 shown in FIG. 1 is eliminated by providing the inner tube 100 and outer tube 102 which, in turn, provide the opening 104 which directs the fluid from the first end 32 of the second cavity 30 to the first exhaust port 46. This is accomplished through the use of conduits 110 and 112 in conjunction with counterbore 120. The elimination of the second exhaust port 48 is accomplished by providing an internal conduit 134 between a completely contained exhaust port 130 and the normal exhaust port 46. The elimination of the piston cavity vent 70 is accomplished by connecting the second portion 22 of chamber 19 with exhaust port 46 by the counterbore 120 and conduit 121 which serves as an extension portion of conduit 112 between the counterbore 120 and the first exhaust port 46. Through the implementation of these concepts, the piston cavity vent 70 is eliminated, the pilot vent 78 is eliminated and the need for a second exhaust port 48 extending through the surface of the valve body 10 is eliminated.

Although the present invention has been described with particular specificity and illustrated in significant detail to show a preferred embodiment of the present invention, it should be understood that many other embodiments of the present invention are within its scope. More specifically, the physical location of the pressure inlet port, the exhaust port, and the cylinder ports are not limiting to the concepts of the present invention. Although the present invention has been illustrated and described as a single solenoid valve, its concepts could alternatively be applied to double solenoid valves are well. In addition, the particular techniques described above to provide the fluid communication between the relevant portions of the valve and pilot valve are not a requirement of the present invention and could be replaced by other methods to achieve the same or similar results.

The embodiments of the invention in which an exclusive property or right is claimed are defined as follows:

1. A valve, comprising:

a valve body having a first cavity formed therein, said valve body having a first exhaust port connected in fluid communication between said first cavity and an outer surface of said valve body;

a spool member disposed within said first cavity, said first cavity being shaped to receive said spool member in sliding association therein, said spool member having a driving end disposed within a chamber of said first cavity between a first portion of said chamber and a second portion of said chamber;

a pilot valve body having a second cavity formed therein;

a plunger disposed within said second cavity, said second cavity having a first end and a second end, said second cavity being shaped to receive said plunger in sliding association between said first and second ends of said second cavity, said second end of said second cavity being connected in fluid communication with said first portion of said chamber; and a first fluid connection between said first end of said second cavity and said first exhaust port, said first fluid connection comprising a single piece inner tube and an outer tube arranged in concentric relation with each other with an opening therebetween, one end of said opening being connected in fluid communication with said first end of said second cavity and an other end of said opening being connected in fluid communication with said first exhaust port, said plunger and said inner tube being shaped to provide a gap therebetween to permit fluid communication between said first and second ends of said second cavity;

a second exhaust port connected in fluid communication with said first cavity, said first and second exhaust ports being connected in fluid communication with each other, said second exhaust port being contained within said valve body;

a second fluid connection between said second portion of said chamber and said first exhaust port; and a solenoid coil disposed around said plunger.

* * * * *